US009357614B2

(12) United States Patent
Lou et al.

(10) Patent No.: US 9,357,614 B2
(45) Date of Patent: May 31, 2016

(54) ILLUMINATION APPARATUS

(75) Inventors: Di Lou, Shanghai (CN); Kun-Wah Yip, Hong Kong (HK)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 285 days.

(21) Appl. No.: 13/997,521

(22) PCT Filed: Dec. 14, 2011

(86) PCT No.: PCT/IB2011/055660

§ 371 (c)(1),
(2), (4) Date: Jun. 24, 2013

(87) PCT Pub. No.: WO2012/085764

PCT Pub. Date: Jun. 28, 2012

(65) Prior Publication Data

US 2013/0271033 A1 Oct. 17, 2013

(30) Foreign Application Priority Data

Dec. 24, 2010 (WO) ..... PCT/CN2010/080252

(51) Int. Cl.

| | |
|---|---|
| ***G05F 1/00*** | (2006.01) |
| ***H05B 37/02*** | (2006.01) |
| ***H05B 33/08*** | (2006.01) |

(52) U.S. Cl.

CPC ..... *H05B 37/02* (2013.01); *H05B 33/0863* (2013.01); *H05B 37/029* (2013.01)

(58) Field of Classification Search

CPC ..... H05B 37/02; H05B 39/04; H05B 33/086; F21V 9/16

USPC ..... 315/297, 291, 324, 307, 192, 312, 360, 315/153, 154, 294, 150; 340/825; 362/231, 362/257, 230

See application file for complete search history.

(56) References Cited

U.S. PATENT DOCUMENTS

| | | | |
|---|---|---|---|
| 5,350,977 | A | 9/1994 | Hamamoto et al. |
| 5,384,519 | A | 1/1995 | Gotoh |

(Continued)

FOREIGN PATENT DOCUMENTS

| | | | |
|---|---|---|---|
| CN | 101107885 | A | 1/2008 |
| CN | 201045454 | Y | 4/2008 |

(Continued)

*Primary Examiner* — Lincoln Donovan
*Assistant Examiner* — Thomas Skibinski
(74) *Attorney, Agent, or Firm* — Meenakshy Chakravorty

(57) ABSTRACT

The invention provides an illumination apparatus and a method of generating light by the illumination apparatus. The illumination apparatus comprises a light generation unit, configured to generate light having a color temperature in the range of [a first color temperature, a second color temperature]; and a controller, configured to control the light generation unit to generate light having a color temperature changing from a third color temperature to a fourth color temperature over time, wherein the third and the fourth color temperatures are in the range of [the first color temperature, the second color temperature]. The illumination apparatus of the invention could generate light having a changing color temperature over time, for example a color temperature changing from a less preferred color temperature to a preferred color temperature. When the user reads under light having a color temperature changing from a less preferred color temperature to a preferred color temperature, the accommodation error of the eyes of the user can be reduced.

20 Claims, 3 Drawing Sheets

(56) References Cited

U.S. PATENT DOCUMENTS

| | | | | |
|---|---|---|---|---|
| 6,616,307 | B2 | 9/2003 | Haenen et al. | |
| 2004/0179360 | A1 | 9/2004 | Kalinski | |
| 2005/0035717 | A1* | 2/2005 | Adamson et al. | 315/150 |
| 2006/0076908 | A1* | 4/2006 | Morgan et al. | 315/312 |
| 2006/0158881 | A1 | 7/2006 | Dowlilng | |
| 2006/0176693 | A1 | 8/2006 | Walter et al. | |
| 2010/0277907 | A1 | 11/2010 | Phipps et al. | |

FOREIGN PATENT DOCUMENTS

| | | | |
|---|---|---|---|
| CN | 101586755 | A | 3/2009 |
| CN | 201269457 | Y | 7/2009 |
| FR | 2886091 | A1 | 11/2006 |
| JP | 6260295 | A | 9/1994 |
| JP | 8293391 | A | 11/1996 |
| WO | 2006133772 | A2 | 12/2006 |
| WO | 20070605578 | A1 | 5/2007 |

* cited by examiner

ILLUMINATION APPARATUS

FIELD OF THE INVENTION

The present invention relates to lighting, particularly an illumination apparatus.

BACKGROUND OF THE INVENTION

In existing desk lamps, different color temperatures (CT) are used, mostly ranging from 2700 K to 6500 K. Some of the existing desk lamps emit light of one color temperature; and others emit light of more than one color temperature, for example 2700 K (warm white light) and 6500 K (cool white light) which are both suitable for use as reading lights. However, all existing desk lamps stick to one constant color temperature over time, unless the user changes or adjusts the current color temperature to another color temperature.

OBJECT AND SUMMARY OF THE INVENTION

People's eyes can accommodate to different visual stimuli, e.g. target objects at different distances. An accommodation error always occurs when the eyes are responding to a visual stimulus, which means that the eyes are always unable to perfectly focus on the target object and form an ideal image on the retina. According to medical knowledge, a large accommodation error occurring over a prolonged period of time will do harm to the eyes, and even degrade the accommodation power of the eyes; whereas reduction of the accommodation error will benefit the eyes in the long run even if people cannot easily notice it.

The inventor has experimentally found that the accommodation error of the eyes of the user can be reduced and by virtue thereof the vision-blurring experience of the user can be significantly improved, if the user reads under light having a color temperature changing from a less-preferred color temperature to a preferred color temperature. For example, if the user prefers the warm white light having a color temperature of 2700 K to the cool white light having a color temperature of 6500 K, the accommodation error of the eyes of the user can be reduced when the user reading under warm white light having a color temperature of 2700 K, i.e. less-preferred color temperature, gradually changes to light having a color temperature of 6500 K, i.e. preferred color temperature.

To better address the above concern, according to one embodiment of the invention, there is provided an illumination apparatus, comprising:

- a light generation unit, configured to generate light having a color temperature in the range of [a first color temperature, a second color temperature];
- a controller, configured to control the light generation unit to generate light having a color temperature changing from a third color temperature to a fourth color temperature over time, wherein the third and the fourth color temperatures are in the range of [the first color temperature, the second color temperature].

Advantageously, the illumination apparatus may further comprise an interface, configured to receive a signal and provide the signal to the controller, wherein the controller is configured to control the change of the color temperature of the light generated by the light generation unit, based on the signal.

Advantageously, when the light generation unit comprises a plurality of light sources, the controller is further configured to control the powers of all or at least part of the plurality of light sources, based on the signal, so as to control the change of the color temperature of the light generated by the light generation unit.

Advantageously, the change of the color temperature of the light generated by the light generation unit ranges from a less-preferred color temperature to a preferred color temperature.

The illumination apparatus of the invention could generate light having a changing color temperature over time, for example, from a less preferred color temperature to a preferred color temperature. When the user reads under light having a color temperature changing from a less preferred color temperature to a preferred color temperature, the accommodation error of the eyes of the user can be reduced.

According to another embodiment of the invention, there is provided a method of generating light by an illumination apparatus, the illumination apparatus comprising a light generation unit capable of generating light having a color temperature in the range of [a first color temperature, a second color temperature], the method comprising:

- controlling the light generation unit to generate light having a color temperature changing from a third color temperature to a fourth color temperature over time, wherein the third and the fourth color temperatures are in the range of [the first color temperature, the second color temperature].

BRIEF DESCRIPTION OF THE DRAWINGS

The invention is explained in further detail, and by way of example, with reference to the accompanying drawings, in which.

Throughout the above drawings, like reference numerals will be understood to refer to like, similar or corresponding features or functions.

DETAILED DESCRIPTION

Reference will now be made to embodiments of the invention, one or more examples of which are illustrated in the figures. The embodiments are provided by way of explanation of the invention, and are not meant as a limitation of the invention. For example, features illustrated or described as part of one embodiment may be used with another embodiment to yield a still further embodiment. It is intended that the invention encompass these and other modifications and variations as come within the scope and spirit of the invention.

Figure 1:
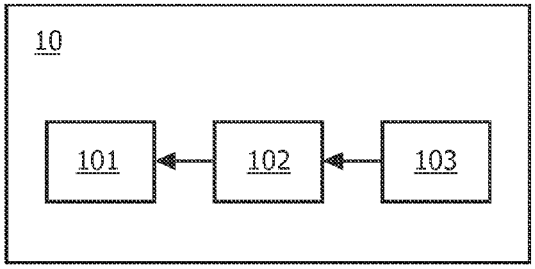
FIG. 1 shows a schematic view of an illumination apparatus 10 according to an embodiment of the invention.

FIG. 1 shows a schematic view of an illumination apparatus 10 according to an embodiment of the invention. The illumination apparatus 10 may be a desk lamp for example.

The illumination apparatus 10 comprises a light generation unit 101, which is capable of generating light having a color temperature in the range of [a first color temperature, a second color temperature]. The light generation unit 101 may comprise a plurality of light sources, and at least two of the plurality of light sources generate light having different color temperatures. The light source may be a fluorescent lamp, a light emitting diode lamp, for example. Also, the light generation unit 101 can be a single light source, whose color temperature can be dynamically controlled by its driving module, e.g., ballast. The number of the light sources in the light generation unit 101 should not be a limitation of the present invention.

The illumination apparatus 10 further comprises a controller 102, which is configured to control the light generation unit 101 to generate light having a color temperature changing from a third color temperature to a fourth color temperature over time. In an example, the third color temperature equals the first color temperature, and the fourth color temperature equals the second color temperature. In another example, the third color temperature equals the second color temperature, and the fourth color temperature equals the first color temperature. In a further example, the third color temperature and the fourth color temperature can be in the range of [the first color temperature, the second color temperature]. The controller 102 may take on any configuration, but generally includes a processor and a digital-to-analog converter.

Advantageously, the illumination apparatus 10 may further comprise an interface 103, which may include one or more options respectively representing one or more illumination modes.

When the user chooses one option on the interface 103, a signal is generated to the controller 102. The controller 102 controls the powers of all or at least part of the plurality of light sources, based on the signal, so as to control the change of the color temperature of the light generated by the light generation unit 101. To make the change of the color temperature unnoticeable to a user, advantageously, the average rate of the change of the color temperature is below a threshold, for example 200 K/min, and the steps in which the change takes place are each below a threshold, for example 20 K.

Hereinafter, for illustrative purposes only, the implementation/configuration of the illumination apparatus of the invention will be described in detail by using a plurality of fluorescent lamps as an illustrative example of the light generation unit, and using a plurality of LED lamps as another illustrative example of the light generation unit. It will be appreciated that a person of ordinary skill in the art can fully appreciate the implementation/operation of the illumination apparatus by using the combination of the fluorescent lamps and the LED lamps as an example of the light generation unit.

Figure 2:
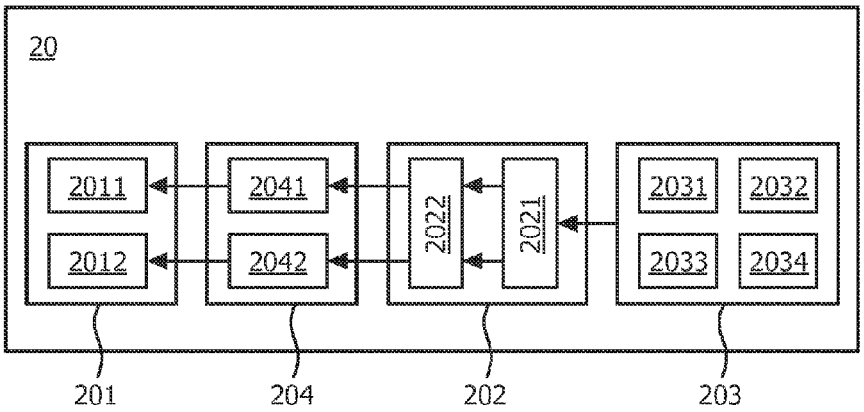
FIG. 2 shows an exemplary illumination apparatus 20 according to an embodiment of the invention.

FIG. 2 shows an exemplary illumination apparatus 20 according to an embodiment of the invention. The exemplary illumination apparatus 20 comprises a light generation unit 201, a controller 202, an interface 203 and a ballast unit 204.

As shown in FIG. 2, the light generation unit 201 comprises two fluorescent lamps 2011, 2012. The fluorescent lamp 2011 is configured to generate warm white light having a color temperature of 2700 K for example, and the fluorescent lamp 2012 is configured to generate cool white light having a color temperature of 6500 K, for example. The configuration of the light generation unit 201 of FIG. 2 is an illustrative example, and it will be appreciated that other configurations of the light generation unit 201 are also possible, such as three fluorescent lamps, four fluorescent lamps, for example.

The ballast unit 204 comprises two electronic ballasts 2041 and 2042, respectively coupled to the two fluorescent lamps 2011 and 2012. By varying the voltages input to the two electronic ballasts 2041 and 2042, the powers of the two fluorescent lamps 2011 and 2012 can be adjusted and thereby different color temperatures of the light generated by the light generation unit 201 can be achieved.

The interface 203 comprises four options 2031, 2032, 2033, 2034 for the user to choose from. Option 2031 represents the color temperature of the light generated by the light generation unit 201 that gradually changes from 2700 K to 6500 K over time; option 2032 represents the color temperature of the light generated by the light generation unit 201 that gradually changes from 6500 K to 2700 K over time; option 2033 represents the color temperature of the light generated by the light generation unit 201 being 2700 K; and option 2034 represents the color temperature of the light generated by the light generation unit 201 being 6500 K. The arrangement of options on the interface 203 of FIG. 2 is an illustrative example, and it will be appreciated that other arrangements of options on the interface 203 are also possible, for example the interface 203 may only include two options, one representing the color temperature changing from 2700 K to 6500 K, and the other representing the color temperature changing from 6500 K to 2700 K. A person skilled in the art will understand that the color temperature does not necessarily have to be 2700 k and 6500 k. It also can be 3000 k and 6600 k.

For the purpose of reducing the accommodation error of the user's eyes, the choice of the user for one of the four options 2031, 2032, 2033, 2034 will be based on his preference for a specific color temperature of the light. For example, the user will choose the option 2031 if he prefers cool white light, e.g., with a color temperature of 6500 K, to warm white light, e.g., with a color temperature of 2700 K, while reading; or the user will choose the option 2032 if he prefers warm white light, e.g., with a color temperature of 3000 K, to cool white light, e.g., with a color temperature of 6000 K, while reading. Certainly, when accommodation error improvement is not taken into consideration, the user may choose any of the four options 2031, 2032, 2033, 2034 on the interface 203 while reading.

The controller 202 comprises a processor 2021 and a digital-to-analog converter 2022. The processor 2021 may be a Micro Control Unit (MCU) for example, which may comprise four pre-stored sets of digital electrical signals corresponding respectively to four illumination modes of the four options on the interface 203. Each set of digital electrical signals may comprise two groups of digital electrical signals, one group for controlling the power of the fluorescent lamp 2011 and the other for controlling the power of the fluorescent lamp 2012. In this embodiment, the digital electrical signal is a voltage signal. It is to be noted that each set of digital electrical signals are pre-calculated according to the corresponding illumination mode and pre-stored in the memory of the MCU.

Hereinafter, the implementation of the illumination apparatus 20 of the embodiment will be described.

When the user chooses one option, for example option 2031 from the four options on the interface 203, based on his preference for a specific color temperature of the light, a signal representing the option 2031 chosen by the user is provided to the processor 2021.

The processor 2021 receives the signal, and selects one set of digital electrical signals corresponding to the illumination mode of option 2031. Subsequently, the processor 2021 provides the selected set of digital electrical signals to the digital-to-analog converter 2022. To be specific, at first, the processor 2021 provides the first two digital electrical signals to the digital-to-analog converter 2022, and the digital-to-analog converter 2022 converts the two digital electrical signals into two analog electrical signals. The two analog electrical signals are then provided to respectively the two electronic ballasts 2041, 2042 to control the power of the two fluorescent lamps 2011, 2012, respectively. After a predetermined interval, the processor 2021 provides the next two digital electrical signals to the digital-to-analog converter 2022, and the digital-to-analog converter 2022 converts the two digital electrical signals into two analog electrical signals. The two analog electrical signals are then provided to respectively the two electronic ballasts 2041, 2042 to further control the power of the two fluorescent lamps 2011, 2012, respectively. Subsequently, the processor 2021 provides the next two digital electrical signals to the digital-to-analog converter 2022, so as to further achieve control of the power of the two fluorescent lamps 2011, 2012. A person skilled in the art should understand that the changes of the two digital electrical signals sent to the digital-to-analog converter 2022 are not necessarily synchronized. They can be asynchronous, or it is even possible that one digital electrical signal for finally controlling one of the lamps is unchanged while the other digital electrical signal for controlling another one of the lamps changes over time.

As the power of each one of the two fluorescent lamps 2011, 2012 is controlled by the controller 202, based on the selected set of digital electrical signals, the illumination mode of generating light having a color temperature changing from a less preferred color temperature, e.g., 2700 K, to a preferred color temperature, e.g., 6500 K, over time by the generation unit 201 is achieved.

Figure 3A:
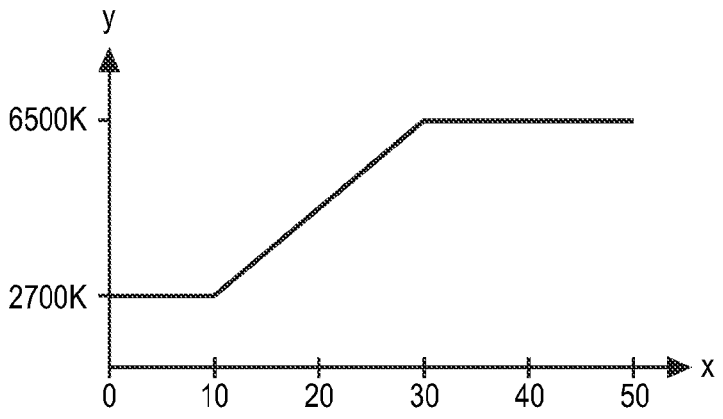
FIG. 3*a* shows an exemplary curve of the change of the color temperature, from 2700 K to 6500 K, of the light generated by the light generation unit 201 of FIG. 2.
Figure 3B:
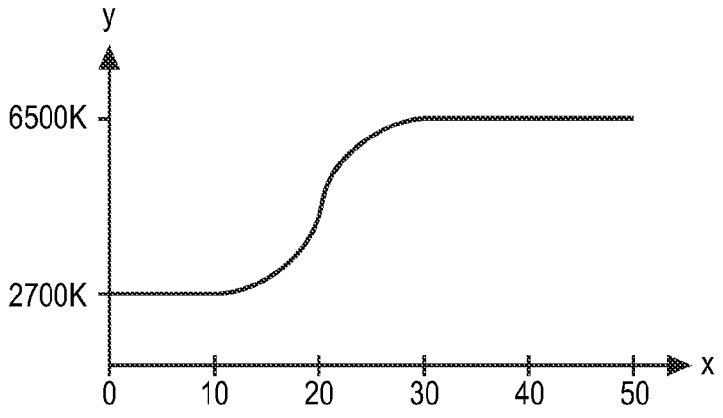
FIG. 3*b* shows another exemplary curve of the change of the color temperature, from 2700 K to 6500 K, of the light generated by the light generation unit 201 of FIG. 2.

FIG. 3*a* shows an exemplary curve of the change of the color temperature, from 2700 K to 6500 K, of the light generated by the light generation unit 201 of FIG. 2. The x-axis of FIG. 3*a* denotes time (in minutes), and the y-axis of FIG. 3*a* denotes color temperature (K). As shown in FIG. 3*a*, in the first ten minutes, the color temperature of the light generated by the light generation unit 201 is kept at 2700 K to help the user focus on his reading; in the next twenty minutes, the color temperature of the light generated by the light generation unit 201 gradually changes from 2700 K to 6500 K; and then the color temperature of the light generated by the light generation unit 201 is kept at 6500 K. The curve of the change of the color temperature of FIG. 3*a* is an illustrative example. It will be appreciated that the change of the color temperature is not limited to a linear curve, and the curvilinear change of the color temperature as shown in FIG. 3*b* is also possible. A stepwise change or other forms of changing are also applicable.

Figure 4:
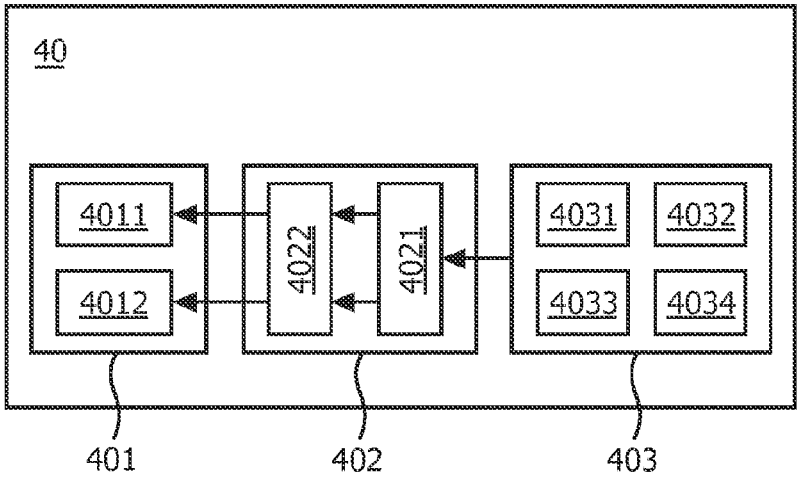
FIG. 4 shows another exemplary illumination apparatus 40 according to an embodiment of the invention.

FIG. 4 shows another exemplary illumination apparatus 40 according to an embodiment of the invention. The exemplary illumination apparatus 40 comprises a light generation unit 401, a controller 402, and an interface 403.

As shown in FIG. 4, the light generation unit 401 comprises two LED lamps 4011, 4012. The LED lamp 4011 is configured to generate warm white light having a color temperature of 2700 K for example, and the LED lamp 4012 is configured to generate cool white light having color temperature of 6500 K, for example. The power of each one of the two LED lamps 4011, 4012 can be adjusted by varying the current input to each one of the two LED lamps 4011, 4012.

The interface 403 comprises four options 4031, 4032, 4033, 4034 for the user to choose from. Option 4031 represents that the color temperature of the light generated by the light generation unit 401 gradually changes from 2700 K to 6500 K over time; option 4032 represents that the color temperature of the light generated by the light generation unit 401 gradually changes from 6500 K to 2700 K over time; option 4033 represents that the color temperature of the light generated by the light generation unit 401 is 2700 K; and option 4034 represents that the color temperature of the light generated by the light generation unit 401 is 6500 K.

The controller 402 comprises a processor 4021 and a digital-to-analog converter 4022. The processor 4021 may be a Micro Control Unit (MCU) for example, which may take the form of four pre-stored sets of digital electrical signals corresponding respectively to four illumination modes of the four options on the interface 403. Each set of digital electrical signals may comprise two groups of digital electrical signals, one group for controlling the power of the LED lamp 4011 and the other for controlling the power of the LED lamp 4012. In this embodiment, the digital electrical signal is a current signal. It is to be noted that each set of digital electrical signals are pre-calculated according to the corresponding illumination mode and pre-stored in the memory of the MCU.

Hereinafter, the implementation of the illumination apparatus 40 of the embodiment will be described.

When the user chooses one option, for example option 4032, from the four options on the interface 403, based on his preference for a specific color temperature of the light, a signal representing option 4032 is provided to the processor 4021.

The processor 4021 receives the signal and, based on this, selects one set of digital electrical signals corresponding to the illumination mode of option 4032 from the four sets of digital electrical signals. Then the processor 4021 provides the selected set of digital electrical signals to the digital-to-analog converter 4022. To be specific, at first, the processor 4021 provides the first two digital electrical signals to the digital-to-analog converter 4022, and the digital-to-analog converter 4022 converts the two digital electrical signals into two analog electrical signals. The two analog electrical signals are then provided to respectively the two LED lamps 4011, 4012 to control the power of each of the two LED lamps 4011, 4012. After a predetermined interval, the processor 4021 provides the next two digital electrical signals to the digital-to-analog converter 4022, and the digital-to-analog converter 4022 converts the two digital electrical signals into two analog electrical signals. The two analog electrical signals are then provided to, respectively, the two LED lamps 4011, 4012 to further control the powers of the two LED lamps 4011, 4012. Subsequently, the processor 4021 provides the next two digital electrical signals to the digital-to-analog converter 4022, so as to achieve further control of the power of each of the two LED lamps 4011, 4012. It can also be easily understood that the changes of digital electrical signals are not necessarily synchronized.

As the power of each of the two LED lamps 4011, 4012 is controlled by the controller 402, based on the selected set of digital electrical signals, the illumination mode of generating light having a color temperature changing from 6500 K to 2700 K over time by the generation unit 401 is achieved.

Figure 5A:
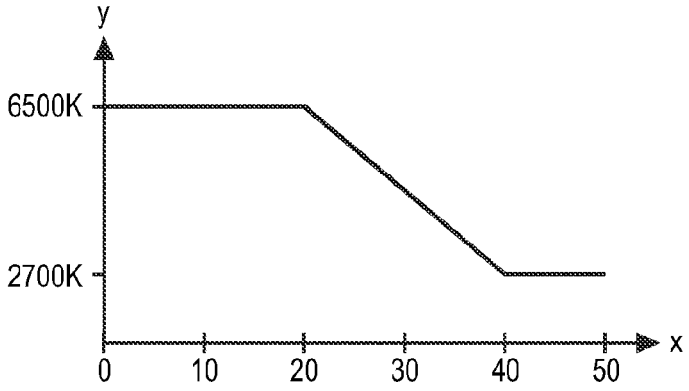
FIG. 5*a* shows an exemplary curve of the change of the color temperature, from 6500 K to 2700 K, of the light generated by the light generation unit 401 of FIG. 4.
Figure 5B:
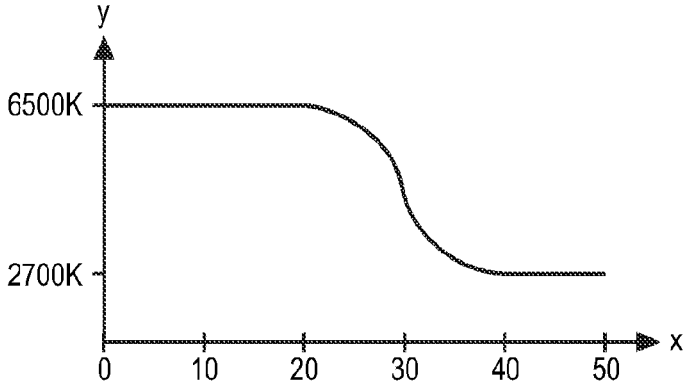
FIG. 5*b* shows another exemplary curve of the change of the color temperature, from 6500 K to 2700 K, of the light generated by the light generation unit 401 of FIG. 4.

FIG. 5*a* shows an exemplary curve of the change of the color temperature, from 6500 K to 2700 K, of the light generated by the light generation unit 401 of FIG. 4. The x-axis of FIG. 5*a* denotes time (in minutes), and the y-axis of FIG. 5*a* denotes color temperature (K). As shown in FIG. 5*a*, in the first ten minutes, the color temperature of the light generated by the light generation unit 401 is kept at 6500 K to help the user focus on his reading; in the next twenty minutes, the color temperature of the light generated by the light generation unit 401 gradually changes from 6500 K to 2700 K; and then the color temperature of the light generated by the light generation unit 401 is kept at 2700 K. The curve of the change of the color temperature of FIG. 5*a* is an illustrative example. It will be appreciated that the change of the color temperature is not limited to a linear curve, and the curvilinear change of the color temperature as shown in FIG. 5*b* is also possible. A person skilled in the art will understand that the "first ten minutes" and the "next twenty minutes" should not be used to limit the duration of each phase. The duration of each phase may be controlled to have a different length, or be set by the user himself/herself, or can be a percentage of the expected reading time the user has input at the beginning of the work session. For example, if a user decides to have a 60 minute read, the duration of the generation of light having a color temperature of 2700 k can be 20 minutes, or 20% of the whole duration, i.e., 12 minutes. And the duration of the change from 2700 k to 6500 k can be 20 minutes, 15 minutes, or 20% of the whole duration, i.e., 12 minutes. The additional advantage here is that the duration of each phase can be adjusted based on the expected working time of the user. Also, each duration can be adjusted based on a user's preference. For example, if a user has a comparatively low tolerance to accommodation error, he may set or program, e.g., when first using the illumination device, a shorter period of generating light having a less-preferred color temperature. If a user has a comparatively high tolerance to accommodation error, he may set or program, e.g., at any time of using the illumination device, a longer period of generating light having a less-preferred color temperature.

It is to be noted that the configuration of the light generation unit 401 of FIG. 4 is an illustrative example. In another embodiment, the light generation unit 401 may comprise more than two LED lamps, for example four LED lamps, the first one being configured to generate warm white light having a color temperature of 2500 K, the second one being configured to generate warm white light having a color temperature of 2700 K, the third one being configured to generate cool white light having a color temperature of 6500 K, and the fourth one being configured to generate cool white light having a color temperature of 6700 K. Any two of the four LED lamps can be controlled to switch on when the illumination apparatus is used for illumination. For example, if the first one and the fourth one are switched on, the light generation unit 401 may generate light having a color temperature changing from 2500 K to 6700 K, or having a color temperature changing from 6700 K to 2500 K; and if the second one and the third one are switched on, the light generation unit 401 may generate light having a color temperature changing from 2700 K to 6500 K, or having a color temperature changing from 6500 K to 2700 K.

The invention further provides a method of generating light by an illumination apparatus. The illumination apparatus comprises a light generation unit which is capable of generating light having a color temperature in the range of [a first color temperature, a second color temperature].

The method comprises a step of: controlling the light generation unit to generate light having a color temperature changing from a third color temperature to a fourth color temperature over time, wherein the third and the fourth color temperatures are in the range of [the first color temperature, the second color temperature].

Advantageously, the method may further comprise a step of: receiving a signal through an interface; and the controlling step in this case comprises a step of: controlling the change of the color temperature of the light generated by the light generation unit, based on the signal.

Advantageously, when the light generation unit comprises a plurality of light sources, the controlling step further comprises a step of: controlling the power of each one of the plurality of light sources, based on the signal, so as to control the change of the color temperature of the light generated by the light generation unit.

Advantageously, the change of the color temperature of the light generated by the light generation unit ranges from a less-preferred color temperature to a preferred color temperature.

The invention further provides a set of computer-executable instructions configured to perform the above steps.

It should be noted that the above described embodiments are given for describing rather than limiting the invention, and it is to be understood that modifications and variations may be resorted to without departing from the spirit and scope of the invention as those skilled in the art readily understand. Such modifications and variations are considered to be within the scope of the invention and the appended claims. The protective scope of the invention is defined by the accompanying claims. In addition, any of the reference numerals in the claims should not be interpreted as a limitation to the claims. Use of the verb "comprise" and its conjugations does not exclude the presence of elements or steps other than those stated in a claim. The indefinite article "a" or "an" preceding an element or step does not exclude the presence of a plurality of such elements or steps.

The invention claimed is:

1. An illumination apparatus for reading comprising:

a light generation unit, configured to generate light having a color temperature in the range of between a first color temperature, and a second color temperature;

an interface configured to provide options for a user to choose the user's preference for a color temperature of light;

a controller, configured to control the light generation unit to generate light having a color temperature changing from a third color temperature to a fourth color temperature over time, wherein the third and the fourth color temperatures are in the range between the first color temperature, and the second color temperature;

wherein the third color temperature is a less preferred color temperature of the user and the fourth color temperature is a preferred color temperature of the user;

wherein the change of the color temperature of the light generated by the light generation unit ranges from the less-preferred color temperature to the preferred color temperature;

wherein the controller changing the light generation unit generated light from the third color temperature to the fourth color temperature uses a first phase, the first phase causing light generation at the third color temperature, a second phase causing light generation to change from the third color to the fourth color, and a third phase causing the light generation at the fourth color temperature;

wherein the second phase limits the color temperature to a set rate of color change over time and a set step color change in which the color change takes place below a threshold.

2. The illumination apparatus of claim 1, further comprising:

an interface, configured to receive a signal and provide the signal to the controller, wherein the controller is configured to control the change of the color temperature of the light generated by the light generation unit, based on the signal.

3. The illumination apparatus of claim 2, wherein the light generation unit comprises a plurality of light sources, and the controller is further configured to control the power of each one of the plurality of light sources, based on the signal, so as to control the change of the color temperature of the light generated by the light generation unit.

4. The illumination apparatus of claim 3, wherein the plurality of light sources comprise a light source generating light having a color temperature in the range of [6000 K, 6800 K], and a light source generating light having a color temperature in the range of [2500 K, 3000 K].

5. The illumination apparatus of claim 3, wherein the third color temperature is the same as the first color temperature, and the fourth color temperature is substantially equal to the second color temperature.

6. The illumination apparatus of claim 3, wherein the third color temperature is the same as the second color temperature, and the fourth color temperature is substantially equal to the first color temperature.

7. The illumination apparatus of claim 3, wherein the controller comprises a processor and a digital-to-analog converter, wherein the processor is configured to generate a plurality of digital electrical signals based on the signal and provide the plurality of digital electrical signals to the digital-to-analog converter; and the digital-to-analog converter is configured to convert the plurality of digital electrical signals into a plurality of analog electrical signals and provide the plurality of analog electrical signals to the plurality of light sources respectively so as to control the power of each one of the plurality of light sources.

8. The illumination apparatus according to claim 7, further comprising:

a plurality of ballasts respectively coupled to the plurality of light sources;

wherein the digital-to-analog converter is configured to provide the plurality of analog electrical signals to the plurality of ballasts respectively.

9. The illumination apparatus of claim 2, wherein the change of the color temperature of the light generated by the light generation unit ranges from a less-preferred color temperature to a preferred color temperature.

10. The illumination apparatus of claim 2, wherein an average rate of the change of the color temperature is below a threshold.

11. The illumination apparatus according to claim 2, wherein the interface is configured to provide options for a user to choose the user's preference for a color temperature of light.

12. The illumination apparatus according to claim 11, wherein the third color temperature is a less preferred color temperature of the user and the fourth color temperature is a preferred color temperature of the user.

13. The illumination apparatus according to claim 12, wherein the change of the color temperature of light generated by the light generation unit from the less-preferred color temperature to the preferred color temperature can reduce an accommodation error of eyes of the user.

14. A method of generating light by an illumination apparatus, the illumination apparatus comprising a light generation unit capable of generating light having a color temperature in the range between a first color temperature, and a second color temperature, the method comprising:

providing options on a user interface for a user to choose the user's preference for a color temperature of light;

controlling the light generation unit to generate light having a color temperature changing from a third color temperature to a fourth color temperature over time, wherein the third and the fourth color temperatures are in the range between the first color temperature, the second color temperature;

wherein the third color temperature is a less preferred color temperature and the fourth color temperature is a preferred color temperature;

wherein the change of the color temperature of the light generated by the light generation unit ranges from a less-preferred color temperature to a preferred color temperature;

maintaining the generated light at the third color temperature for a predetermined first phase set by the user interface;

changing the generated light from the third color temperature to the fourth color temperature over a predetermined second phase set by the user interface;

maintaining the generated light at the fourth color temperature for a predetermined third phase set by the user interface.

15. The method of claim 14, further comprising:

receiving a signal through the interface;

wherein the controlling step further comprises:

controlling the change of the color temperature of the light generated by the light generation unit, based on the signal.

16. The method of claim 15, wherein the light generation unit comprises a plurality of light sources, the controlling step further comprising:

controlling the power of each one of the plurality of light sources, based on the signal, so as to control the change of the color temperature of the light generated by the light generation unit.

17. The method of claim 15, wherein the change of the color temperature of the light generated by the light generation unit ranges from a less-preferred color temperature to a preferred color temperature.

18. The method of claim 15, wherein the interface is configured to provide options for a user to choose the user's preference for a color temperature of light and wherein the third color temperature is a less preferred color temperature of the user and the fourth color temperature is a preferred color temperature of the user.

19. The method of claim 18, wherein the change of the color temperature of light generated by the light generation unit from the less-preferred color temperature to the preferred color temperature can reduce an accommodation error of eyes of the user.

20. A set of computer executable instructions, configured to perform a method of generating light by an illumination apparatus, the illumination apparatus comprising a light generation unit capable of generating light having a color temperature in the range between a first color temperature, and a second color temperature, the method comprising:

controlling the light generation unit to generate light having a color temperature changing from a third color temperature to a fourth color temperature over time, wherein the third and the fourth color temperatures are in the range between the first color temperature, the second color temperature;

wherein the controlling the light generation unit to generate light from the third color temperature to the fourth color temperature limits the change in color temperature below a threshold of change over time set by a user interface.

* * * * *